US007712838B2

(12) United States Patent
Walker et al.

(10) Patent No.: US 7,712,838 B2
(45) Date of Patent: May 11, 2010

(54) GROUND SUPPORT INSERTION TOOL

(76) Inventors: Roland C. Walker, 3900 W. 700 S., Salt Lake City, UT (US) 84104; Matthew S. Slatter, 3900 W. 700 S., Salt Lake City, UT (US) 84104; Phillip E. Gramich, Jr., 3900 W. 700 S., Salt Lake City, UT (US) 84104

( * ) Notice: Subject to any disclaimer, the term of this patent is extended or adjusted under 35 U.S.C. 154(b) by 53 days.

(21) Appl. No.: 12/080,100

(22) Filed: Mar. 31, 2008

(65) Prior Publication Data

US 2008/0236898 A1 Oct. 2, 2008

Related U.S. Application Data

(60) Provisional application No. 60/909,314, filed on Mar. 30, 2007.

(51) Int. Cl.
*E21B 4/06* (2006.01)
*E21D 20/00* (2006.01)

(52) U.S. Cl. ..... 299/11; 175/293; 175/320; 405/259.6

(58) Field of Classification Search ..... 299/11; 175/293, 320; 405/259.6, 259.1, 302.4
See application file for complete search history.

(56) References Cited

U.S. PATENT DOCUMENTS 2,424,092 A * 7/1947 Hammond et al. ..... 428/599
2,854,217 A * 9/1958 Benjamin ..... 173/38
3,193,055 A * 7/1965 Morin ..... 173/46
4,889,191 A * 12/1989 Fausett, Sr. ..... 173/1
5,544,980 A * 8/1996 Seegmiller ..... 405/259.6
5,873,689 A 2/1999 Mensour et al.
6,390,735 B1 * 5/2002 Gaudreau et al. ..... 405/259.6
6,598,688 B2 * 7/2003 Wang ..... 175/320

FOREIGN PATENT DOCUMENTS

CA 2460497 10/2004

* cited by examiner

*Primary Examiner*—Shane Bomar
(74) *Attorney, Agent, or Firm*—Ronald R. Kilponen

(57) ABSTRACT

An improved ground support member insertion device comprising means for attaching the device to a jackleg drill, a clutch assembly disposed adjacent to the attaching means and adapted for holding a ground support member while it is being inserted into a first drill hole; and, anchoring means disposed opposite the clutch assembly and adapted for temporarily anchoring the device for stabilization in a rock formation during insertion of the ground support member. An impact tool for engaging the proximate end of the ground support member providing rotation and impact to the ground support member to mix the resin and to secure the ground support member in a rock formation. The impact tool can also be used to manually or mechanically tension the ground support member once installed.

7 Claims, 12 Drawing Sheets

GROUND SUPPORT INSERTION TOOL

PRIORITY

This application claims the benefit of U.S. Provisional Application for Patent No. 60/909314 with filing date of Mar. 30, 2007.

FIELD

The present embodiments relate generally to mining ground support and particularly to an improved apparatus and method for inserting ground support members during mining ground support operations.

BACKGROUND

Ground support apparatus and methods using combined mechanical and chemical means are well known in the mining, tunneling and construction industries. Basically, a hole is drilled in the surrounding rock formation from unstable to stable strata. Packaged resin compounds are inserted into the drilled hole. A ground support member is then inserted into the drilled hole which punctures and mixes the resin packages.

The member is rotated to ensure that the resin mixes and fills the annulus between the member and the inside surface of the drilled hole. The resin hardens and then the member is tensioned to a predetermined load. To facilitate the ground support operation, a variety of machines have been proposed to insert the ground support member into the drill hole. One such machine is described in application CA 2460497 Rebar Insertion Device by John Fifield filed on 2004 Mar. 9. This device works well in many ground support applications but it has a number of weaknesses that have become apparent from field use.

For example, a significant amount of force is required to push a ground support member into a pre-drilled hole and through packaged resin. This force is applied by the pusher leg or jackleg which is a pneumatic or hydraulic piston to which the drill is attached. As this force is applied to the ground support member, lateral forces are created in the pusher leg and in the supports of the pusher leg which have been found to destabilize the apparatus because it is not supported for these loads. This causes the jackleg drill and pusher leg to move and swivel, which can damage the ground support member and may create a worker hazard.

Therefore there is a need to resolve this problem to prevent damage to the ground support member which may compromise its structural integrity and to discourage injury to the drill operator.

SUMMARY

The problem is deterred by the provision of an improved ground support member insertion device comprising means for attaching the device to a jackleg drill, a clutch assembly disposed adjacent to the attaching means and adapted for holding a ground support member while it is being inserted into a first drill hole; and, anchoring means disposed opposite the clutch assembly and adapted for temporarily anchoring the device for stabilization in a rock formation during insertion of the ground support member.

The attaching means is separated from the clutch assembly by a rectangular channel welded between the clutch assembly and the anchoring means. The rectangular channel further comprises a front, a back, a first side and a second side. The clutch assembly comprises a rectangular housing welded to the front of the rectangular channel and a roller housed within the rectangular housing. The roller is adapted for frictional rolling engagement with the ground support member. The roller is eccentrically mounted on an axle for limited pivoting movement about the axle.

The rectangular housing comprises an open bottom, a partially closed top, a first side, a second side, a back and a front. The open bottom facilitates insertion of the ground support member into the device. The partially closed top comprises a top plate adapted to permit passage of the ground support member through the rectangular housing while impeding debris from entering the rectangular housing by way of the partially closed top.

The first side is at least partially enclosed by a first side plate. The second side is at least partially enclosed by a second side plate. The first side plate and the second side plate are adapted to guide the movement of the roller within the rectangular housing. The front is enclosed by a front plate attached to at least one of the first and second side plates. The front plate has a flat outside surface and an inside surface having a groove adapted for frictional siding engagement with the ground support member as it passes through the housing. The back is enclosed by a back plate attached to the front of the rectangular channel.

The first and second side plates comprise respective first and second apertures disposed opposite to each other for mounting the axis of the roller. The first and second side plates further comprise respective third and fourth apertures disposed opposite to each other for mounting a tensionable reinforcing member that also acts as a bottom stop for the roller. The tensionable reinforcing member is further adapted to ensure parallel alignment of the first and second side plates. The anchoring means comprises a first projecting member fixed to the back of the rectangular channel. The member has a first end disposed downward for attachment to the jackleg drill and a second threaded end disposed upward for threaded attachment to an anchoring member for insertion into a second predrilled hole having a depth in the rock formation and adapted for temporarily receiving the anchoring member.

There is a second projecting member fixed to the back of the rectangular channel adjacent to the first projecting member and disposed downward for reinforcement in order to impede device rotation during the insertion of the ground support member. The anchoring member comprises a first end adapted for inserting into the second predrilled hole and a second threaded end adapted for threaded engagement with the threaded second end of the first projecting member. The anchoring member has a length less than the depth of the second predrilled hole.

The anchoring member is adapted to resist lateral forces resulting from resistance to the ground support member being inserted into the first predrilled hole. The ground support member is inserted between the roller member and the groove in the inside surface of the front plate act in frictional engagement, so that when the ground support member receives a thrust from the jackleg drill or manually, it is pushed towards the first hole and the roller pivots upwards in a releasing action permitting frictional movement of the ground support member, and so that when the thrust is removed, gravity will pull the ground support member down thereby permitting the roller to pivot downwards and into a position wherein it acts in a pinching combination with the groove to generate a pinch force capable of holding the ground support member stationary against the force of gravity.

A ground support member insertion kit for use in combination with a jackleg drill is also provided and comprises a ground support member insertion device comprising attaching means for attaching the device to a jackleg drill, a clutch assembly disposed adjacent to the attaching means and adapted for holding a ground support member while it is being inserted into a first drill hole that has been pre-loaded with resin, anchoring means disposed opposite the clutch assembly and adapted for temporarily anchoring the device in a rock formation during insertion of the ground support member; and, an impact tool temporarily fixable to the jackleg drill and adapted for engaging a cap on the proximate end of the ground support member by engagement means and transmitting percussive and rotational movement to the ground support member during insertion into the resin of first drill hole.

There is also provided a system for installing a ground support member with resin comprising a rock drill for drilling a first hole for permanently accepting the ground support member and resin in combination and a second hole for temporarily accepting an anchoring member for stabilization, a jackleg drill for mounting the rock drill and for providing thrust to the ground support member during insertion into the first hole and resin, a ground support member insertion device temporarily mounted to the jackleg drill for holding the ground support member during insertion into the first hole. The device acts in cooperation with the anchoring member to stabilize the jackleg drill during insertion. The system further includes an impact tool temporarily fixable to the jack leg or rock drill and adapted for engaging a cap on the proximate end of the ground support member by engagement means and transmitting percussive and rotational forces from the rock drill to the ground support member during insertion into the resin and tensioning of the ground support member.

There is also a method for inserting a ground support member permanently into a first hole filled with resin comprising the steps of:

a. drilling the first hole having a first depth using a jackleg drill;
b. inserting a bonding agent including resin into the first hole;
c. drilling a second hole having a second depth using the jackleg drill wherein the second depth is less than the first depth;
d. installing a ground support member insertion device onto the jackleg drill, the ground support member insertion device comprising:
e. attaching means for attaching the device to the jackleg drill;
f. a clutch assembly disposed adjacent to the attaching means and adapted for holding a ground support member while permitting movement of the ground support member in a distal direction and preventing movement in a proximate direction; and,
g. anchoring means disposed opposite the clutch assembly, the anchoring means comprising an anchoring member adapted for temporarily anchoring the device in the second hole during insertion of the ground support member for stability;
h. temporarily fixing the anchoring member to the ground support member insertion device;
i. maneuvering the jackleg drill so that the anchoring member is inserted into the second hold and the ground support member insertion device is poised below the first hole;
j. inserting a ground support member into the clutch assembly, wherein the ground support member comprises a distal end for insertion into the first hole and a proximate end adapted to receive thrust from the jackleg drill, and wherein the ground support member is held stationary within the clutch until a first thrust is applied from the jackleg drill;
k. applying a first thrust from the jackleg drill to the proximate end of the ground support member thereby forcing it through the clutch and into the first hole a first distance so that the distal end of the ground support member engages the binding resin;
l. withdrawing the jackleg drill a second distance thereby removing thrust from the ground support member and engaging the clutch so that the grounds support member is held stationary;
m. applying a second thrust to the proximate end of the ground support member in order to move it a second distance into the first hole;
n. repeating steps k to m until the ground support member is in a desired location;
o. removing the ground support member insertion device from the jackleg drill;
p. installing an impact tool on the jackleg drill whereby the distal end of the impact tool engages the proximate end of the ground support member by engagement means thereby permitting the transmission of percussive and rotational forces from the jackleg drill to the ground support member until a desired resin mix is achieved within the ground support member; and
q. allowing the resin to set in a binding relationship with the ground support member.

DETAILED DESCRIPTION

Figure 1:
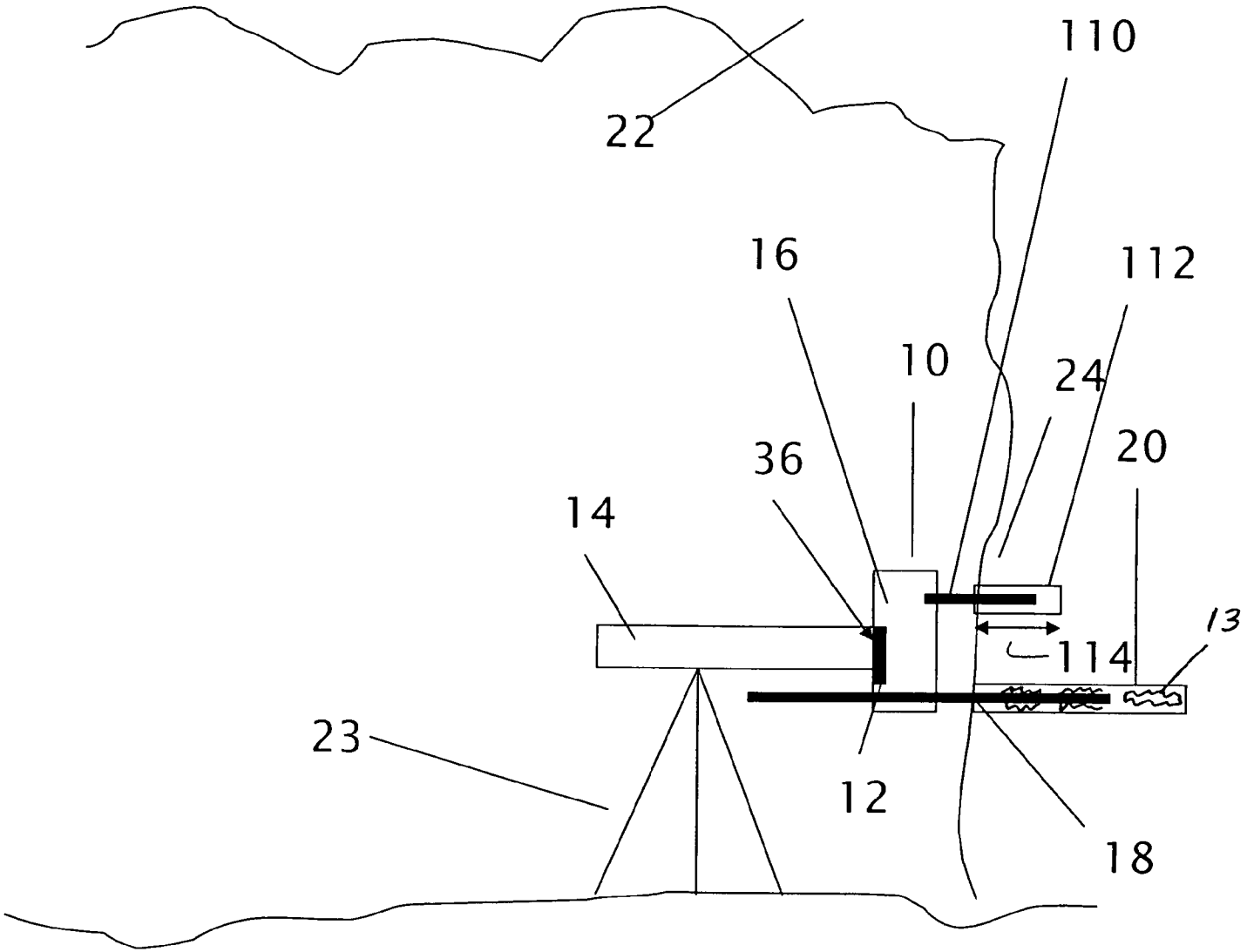
FIG. 1 shows a schematic drawing of one embodiment of a jackleg leg drill in a mine.

Referring to FIG. 1, there is shown a schematic view of one embodiment of the device being an improved ground support member insertion device (10) comprising means (24) for attaching the device to a jackleg drill (14). A clutch assembly (16) is disposed adjacent to the attaching means (24) and separated from the attaching means by a rectangular spacing member (26) (FIG. 3) adapted to provide proper spacing between the jackleg drill (14) and the clutch assembly (16).

The clutch assembly (16) is adapted for holding and guiding a ground support member (18) while it is being inserted into a first drill hole (20) within a rock body (22). The jackleg drill (14) is also called a pushleg drill and is a pneumatic or hydraulic assisted device used to provide thrust to the drill bit in drilling operations.

Figure 2:
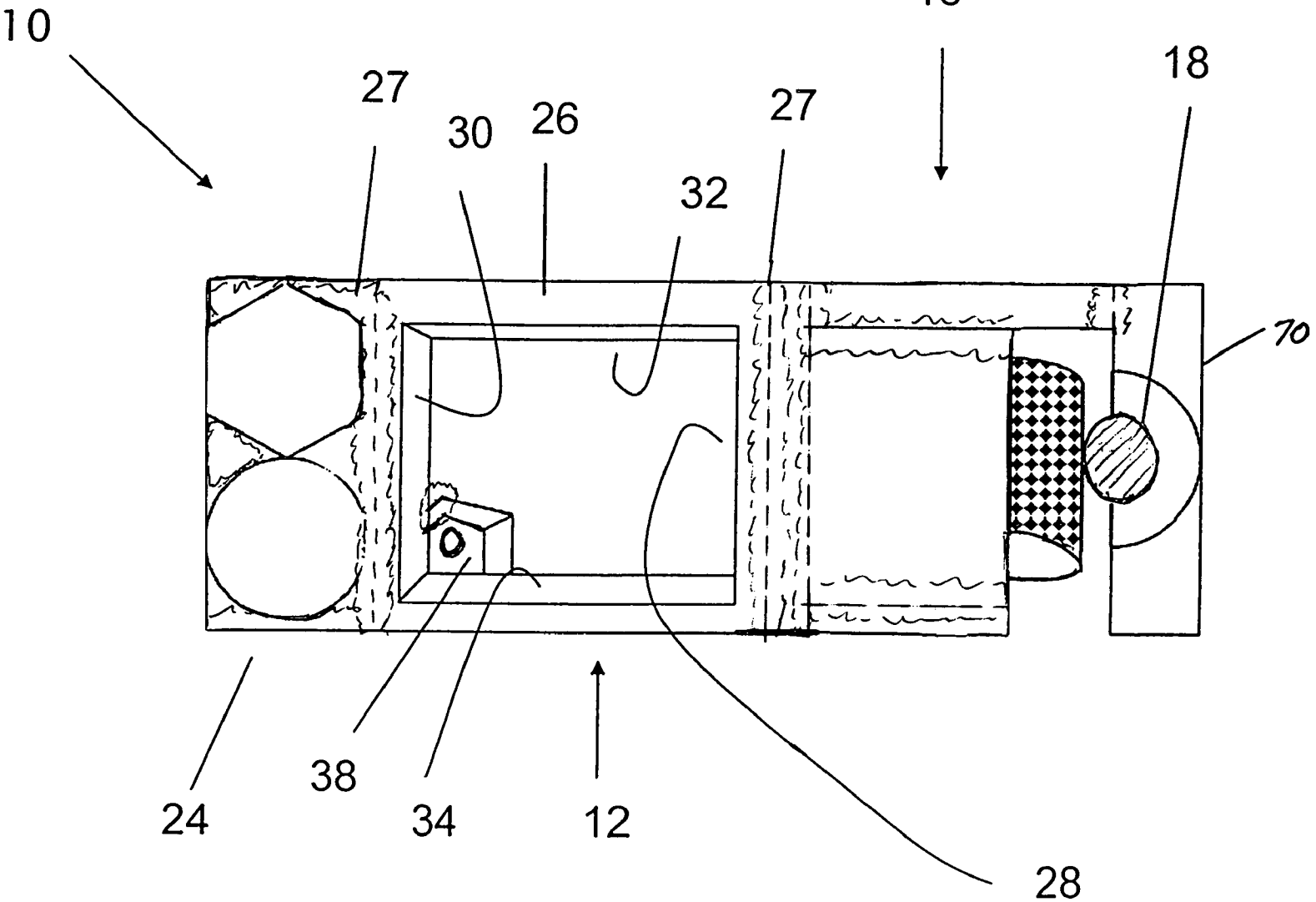
FIG. 2 shows a schematic drawing of the top of one embodiment of the device.

Referring to FIG. 1 and FIG. 2, in another example of the support member insertion device (10) there is illustrated schematically in a top view other elements of the device including anchoring means (24) disposed opposite the clutch assembly (16). The anchoring means (24) are adapted for temporarily anchoring the insertion device (10) in the rock body (22) during insertion of the ground support member (18) and for attaching the insertion device (10) to the jackleg drill (14).

Rectangular channel member (26) is welded (27) between the clutch assembly (16) and the anchoring means (24). The rectangular channel member (26) comprises a front (28), a back (30), a first side (32) and a second side (34). The rectangular channel member (26) provides spacing between the clutch assembly (16) and the end (36) of the jackleg drill (14).

Figure 3:
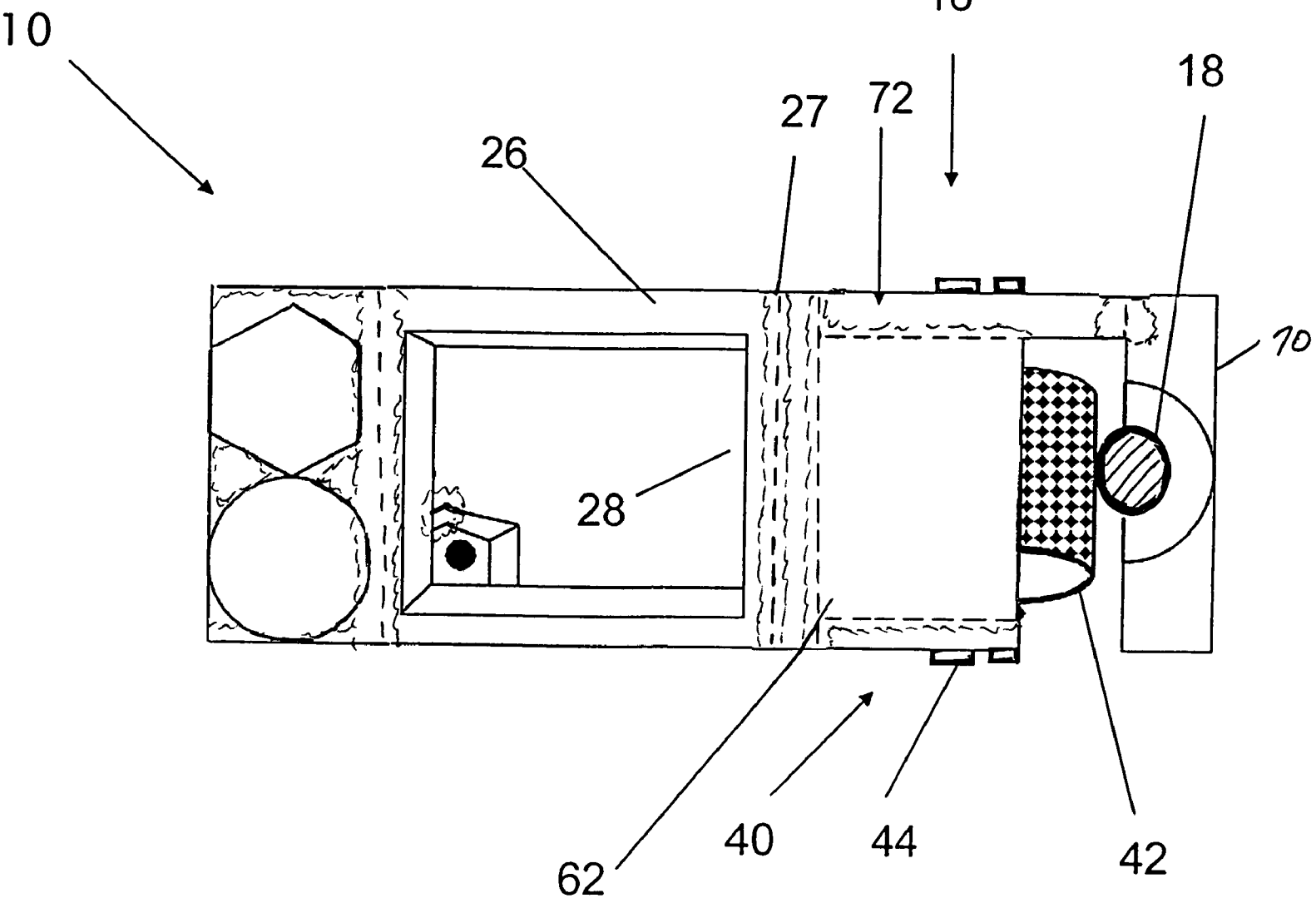
FIG. 3 shows a schematic drawing of the top of one embodiment of the device.

Referring now to FIG. 3, which is identical to FIG. 2, the clutch assembly (16) comprises a rectangular housing (40) welded (27) to the front (28) of the rectangular channel member (26). Within the rectangular housing (40) is housed a roller (42). The roller (42) is adapted for a frictional rolling engagement with the ground support member (18) as more fully explained below.

Figure 4:
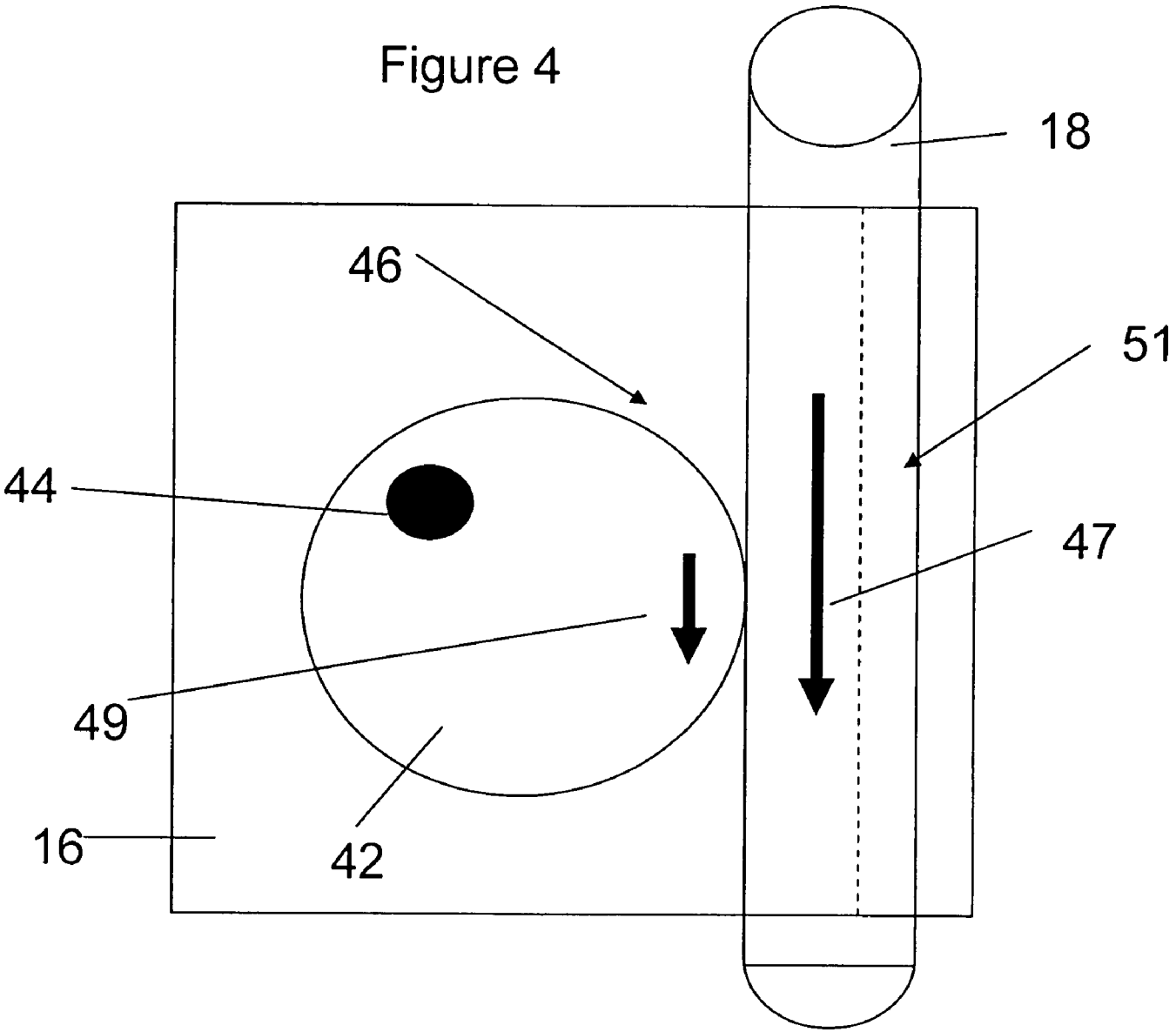
FIG. 4 shows a schematic side view of one embodiment of a reinforcing member of the clutch assembly.
Figure 5:
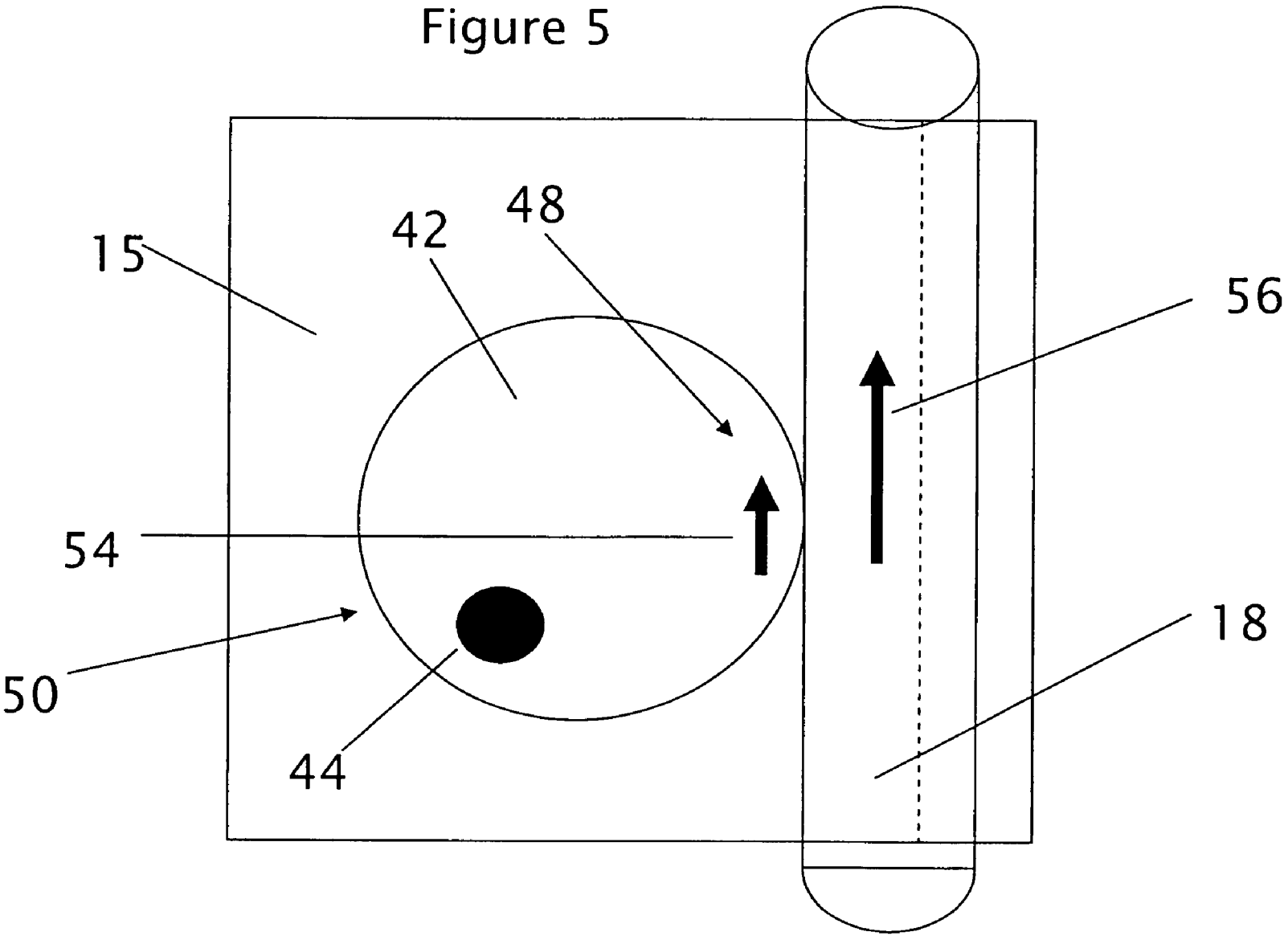
FIG. 5 shows another schematic view of one embodiment of a reinforcing member in one embodiment of a clutch assembly.

Referring to FIG. 4 and FIG. 5, the roller (42) is eccentrically mounted on an axle (44) within the clutch housing (16). The axle (44) provides for a limited pivoting movement between a first engaged position (46) when the roller is acting to prevent the ground support member (18) from moving backwards (47) by moving in a clockwise (49) rotation about the axis in order to pinchingly engage the ground support member (18) within the groove (51).

Referring to FIG. 5, there is a second disengaged position (48) of roller (42). In the disengaged position (48) the roller (42) is rotated counter clock-wise (54) about the axle (44) so that it disengages the ground support member (18) and permits one-way movement (56) of the ground support member (18) towards the first hole (20). The surface (50) of the roller is always in a frictional engagement with the grounds support member (18) while it is moving so that should forces of gravity act on the ground support member (18) the roller (42) will automatically engage into its engagement position (46) thereby locking the ground support member (18) in place. The surface (50) of the roller (42) is adapted for frictional engagement with the steel ground support member (18) and in one example of the surface (50) it may be knurled. Other types of surface patterns are also possible to obtain the same gripping effect between the surface (50) of the roller (42) and the surface of the ground support member (18).

Referring to FIGS. 1 to 6, the ground support member (18) is inserted between the roller (42) and the groove (51) in the inside surface (84) of the front plate (70) and cooperate in a frictional engagement, so that when the ground support member (18) receives thrust from the jackleg drill (14) it is pushed towards the first hole (20) and the roller pivots counterclockwise or upwards (54) in a releasing action permitting frictional movement of the ground support member (18) through the clutch assembly (16). When the thrust is removed, a backwards movement or gravity (47) will pull the ground support member (18) down, thereby permitting the roller to pivot clockwise or downwards (49) and into the first position (46) wherein it acts in a pinching combination with the groove (51) to generate a pinch force capable of holding the ground support member (18) stationary against the force of gravity.

Figure 6:
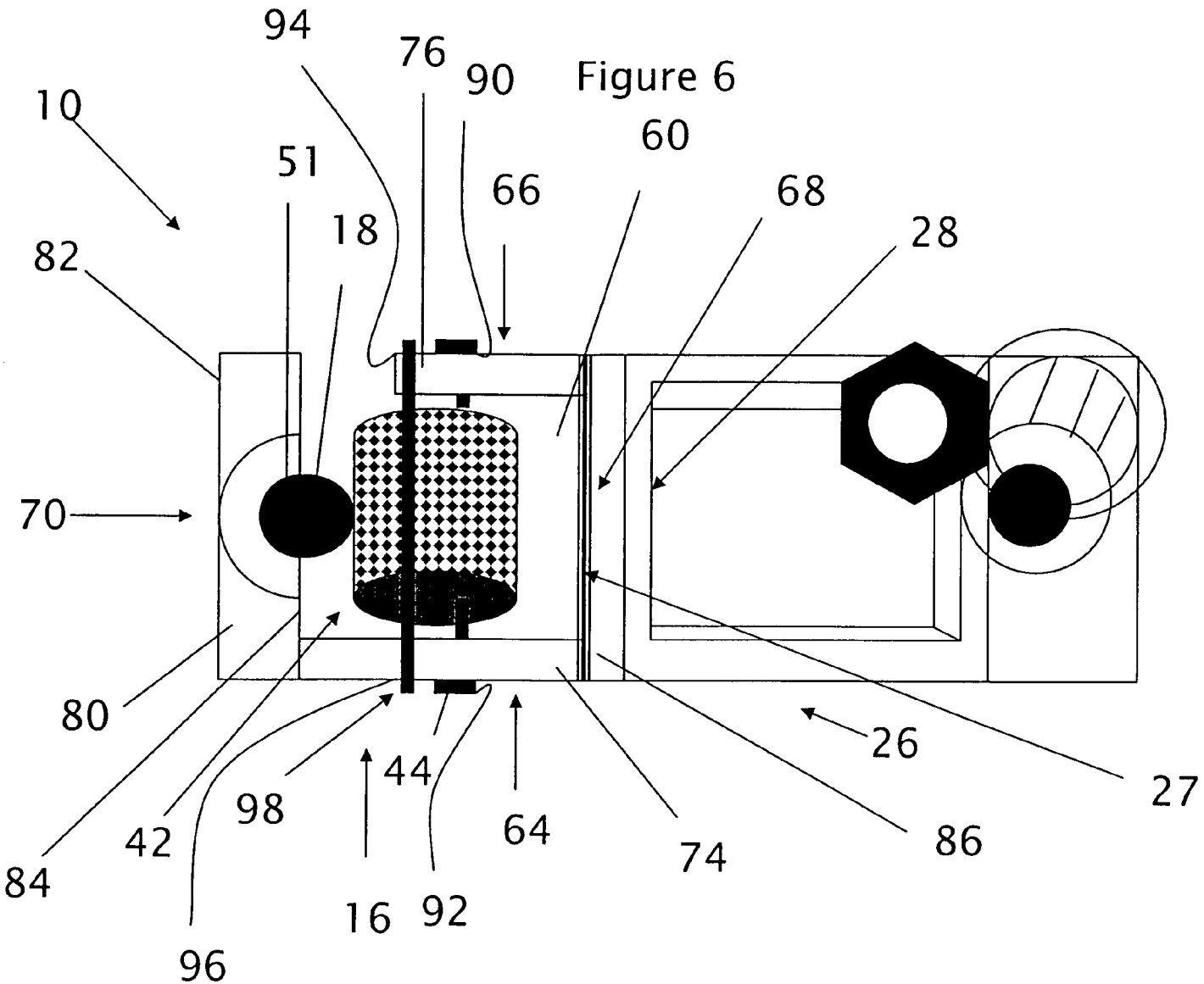
FIG. 6 shows a bottom view of one embodiment of the device.

Still referring to FIG. 6, there is shown a bottom view of the ground support member (18) insertion device (10). The rectangular housing (16) comprises an open bottom (60), a partially closed top (62 FIG. 3), a first side (64), a second side (66), a back (68) and a front (70). The open bottom (60) facilitates insertion of the ground support member (18) into the groove (51) in front of the roller (42). The partially closed top (62) comprises a top plate (72 FIG. 3) adapted to permit passage of the ground support member (18) through the clutch assembly (16) while impeding debris from entering the clutch assembly (16) by way of the partially closed top.

The first side (64) is at least partially enclosed by a first side plate (74). The second side (66) is at least partially enclosed by a second side plate (76). The first side plate (74) and the second side plate (76) are adapted to guide the movement of the roller (42) within the clutch assembly (16). The front (70) is enclosed by a front plate (80) attached to at least one of the first and second side plates. The front plate (80) has a flat outside surface (82) and an inside surface (84) having groove (51) adapted for frictional siding engagement with the ground support member (18) as it passes through the clutch assembly (16).

The back (68) is enclosed by a back plate (86) that is attached by welding (27) to the front (28) of the rectangular channel member (26). The first (74) and second (76) side plates comprise respective first (90) and second (92) apertures disposed opposite to each other for mounting the axle (44) of the roller (42). The first and second side plates further comprise respective third (94) and fourth (96) apertures disposed opposite to each other for mounting a tensionable reinforcing member (98) that also acts as a bottom roller stop. The tensionable reinforcing member (98) is further adapted to ensure parallel alignment of the first and second side plates.

Figure 7:
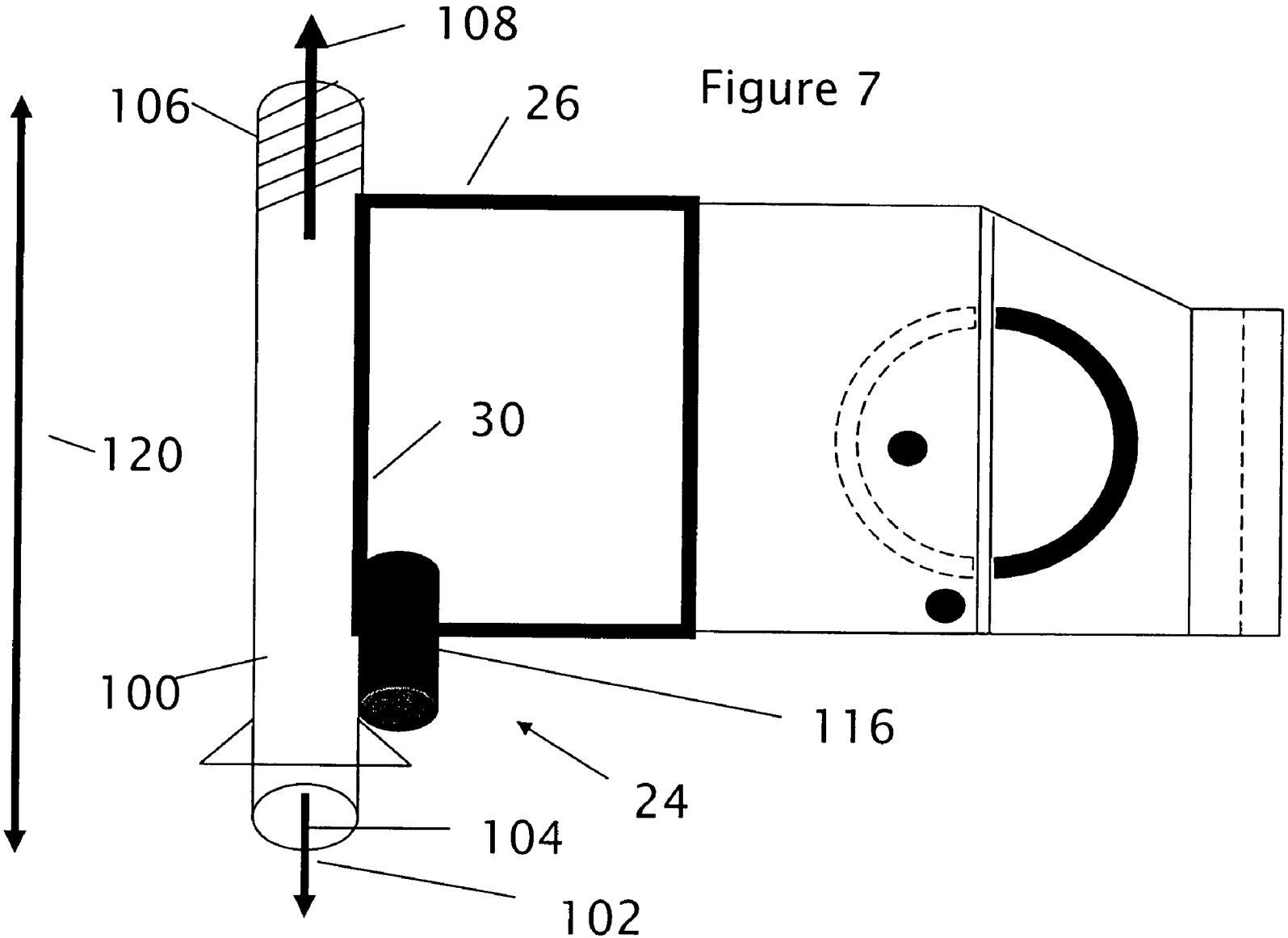
FIG. 7 shows a side view of the one embodiment of the device.

Referring to FIG. 7, there is shown another example of the ground support member insertion device (10) in a first side view. The anchoring means (24) comprises a first projecting member (100) fixed to the back (30) of the rectangular channel member (26). The first projecting member (100) is a single length of steel rod. The first projecting member (100) has a first end (102) disposed downward (104) for attachment to the jackleg drill. The first projecting member (100) has a second threaded end (106) disposed upward (108) for threaded attachment to an anchoring member (110) further described in FIG. 8.

Referring back to FIG. 1, there is a second predrilled hole (112) having a depth (114) in the rock formation (22) that is adapted for temporarily receiving the anchoring member (110). Depth (114) is generally greater than the length (120) of the anchoring member (110).

Referring back to FIG. 7, there is illustrated a second projecting member (116) fixed to the back of the rectangular channel member (26) adjacent to the first projecting member (100) and disposed downward for reinforcement and to impede device rotation while fixed to the jackleg drill (14) during the insertion of the ground support member (18).

Figure 8:
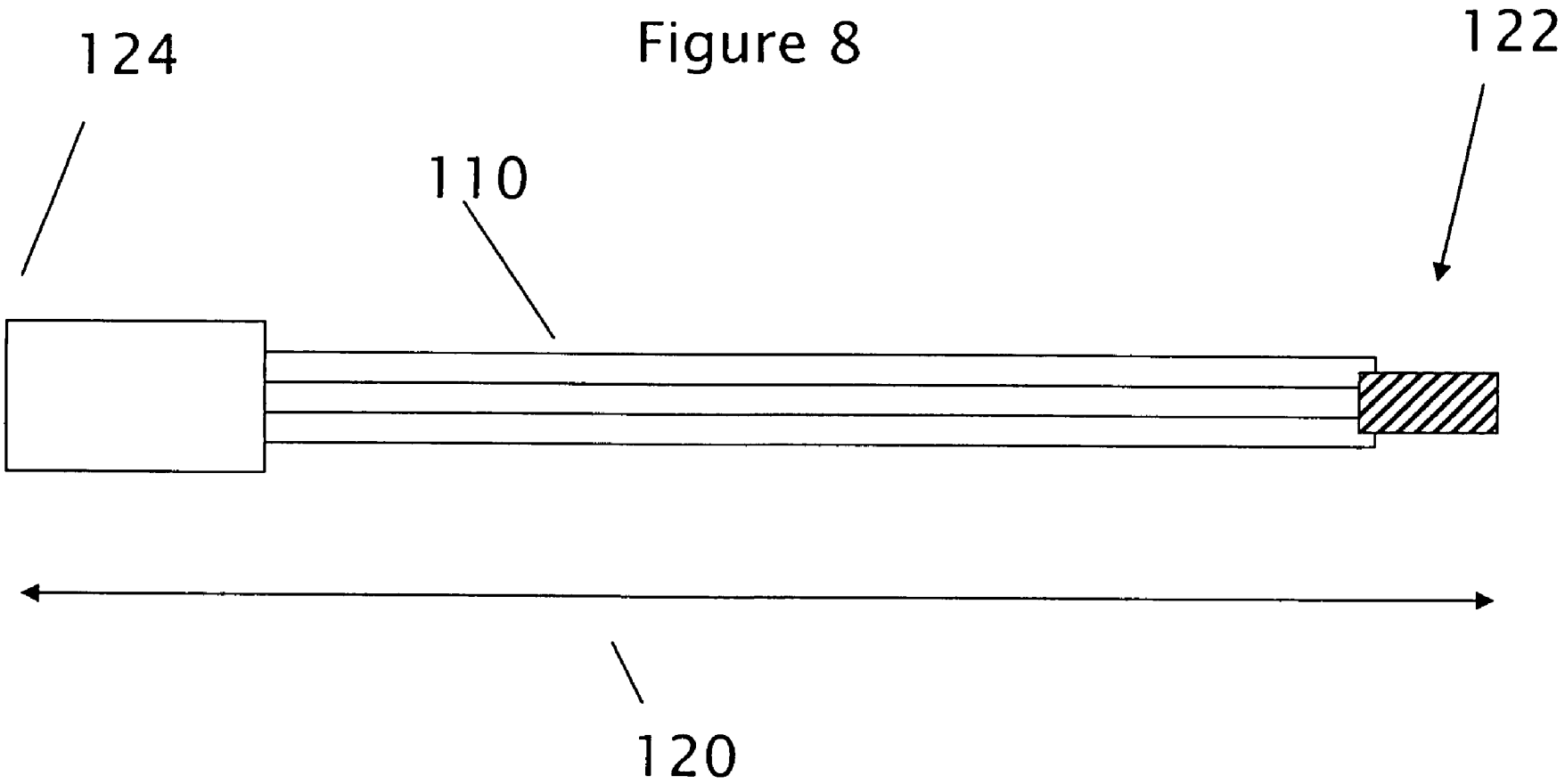
FIG. 8 shows a side view of one embodiment of the anchoring member.

Referring to FIG. 8, the anchoring member (110) comprises a length (120) of solid steel comprising a first end (122) adapted for inserting into the second predrilled hole (112) and a second threaded end (124) adapted for threaded engagement with the second threaded end (106) of the first projecting member (100). The anchoring member (110) has a length (120) less than the depth (114) of the second predrilled hole (112). Once the anchoring member (110) is inserted into the second predrilled hole (112) it is adapted to resist lateral forces resulting from resistance to the ground support member (18) being inserted into the first predrilled hole (20) by the thrust of the jackleg drill (14).

In another example of the device, the improved ground support member insertion device (10) is used in combination with a jackleg drill (14). The device comprises means for attaching the device to the jackleg drill (14) and a clutch assembly (16) disposed adjacent to the attaching means. The clutch assembly (16) is adapted for holding a ground support member (18) while it is being inserted into a first drill hole (20). Anchoring means (24) is disposed opposite the clutch assembly (16) for temporarily anchoring the device in a second hole (112) in the rock formation (22) during insertion of the ground support member (18).

In another example of the device there is provided a ground support member insertion device (10) kit for use in combination with a jackleg drill (14). The insertion kit comprises a ground support member insertion device (10) comprising means for attaching the device to a jackleg drill (14), a clutch assembly (16) disposed adjacent to the attaching means and adapted for holding a ground support member (18) while it is being inserted into a first drill hole (20) and anchoring means disposed opposite the clutch assembly for temporarily anchoring the device in a rock formation (22) during insertion of the ground support member (18).

Figure 9:
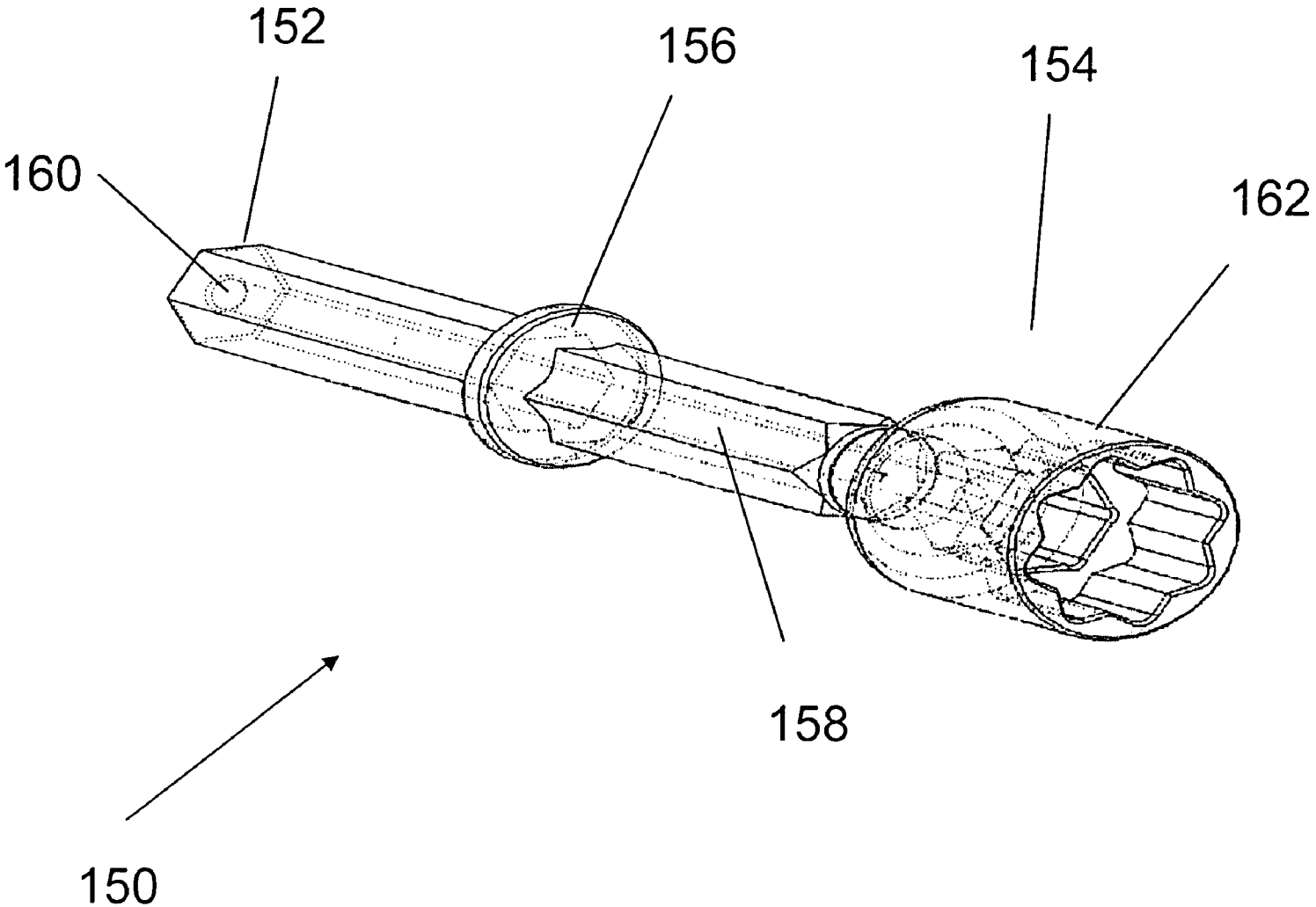
FIG. 9 shows a perspective view of one embodiment of the impact tool.
Figure 10:
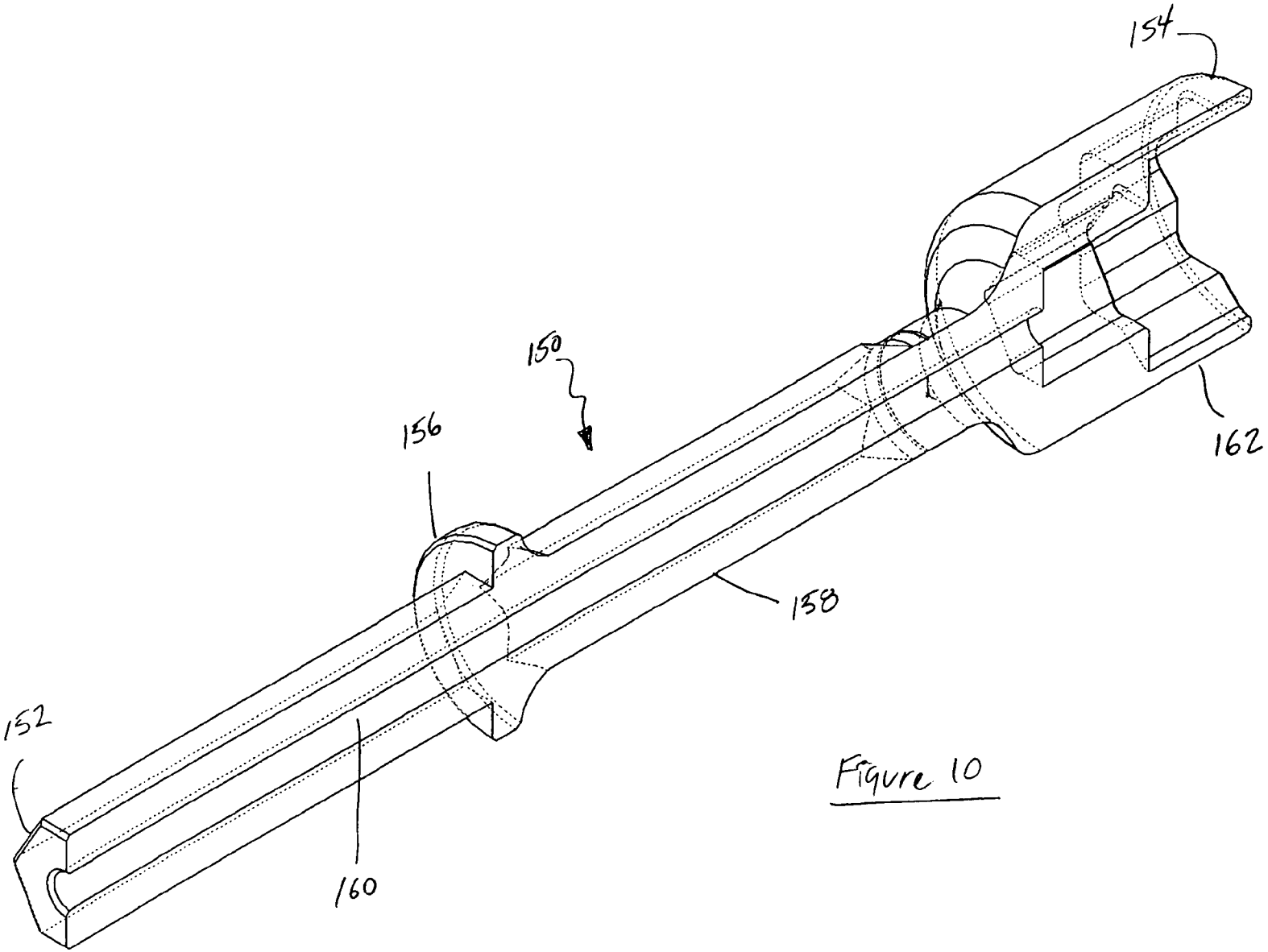
FIG. 10 shows a cross sectional perspective view of one embodiment of the impact tool.

Referring to FIG. 9, a there is also provided in the kit an impact tool (150) that is temporarily fixable to the jackleg drill (14). The impact tool has a first end (152) and a second end (154). The first end (152) is adapted for connection with the jackleg drill (14) and the second end (154) is adapted for connection with a torquing nut (not shown) on the end of the ground support member (18). Between the first end and the second end is a flange (156) that is adapted to sit on the end of the jackleg drill (14) to separate the drill from the second end (154). The shaft (158) of the impact tool (150) is manufactured from steel that may have a hollow core (160) and is generally six-sided for better gripping by the jackleg drill (14) chuck. The second end (154) includes a socket (162) that is adapted to fit over an eight-pointed nut. The socket (162) on the shaft (158) of the impact tool (150) can be manufactured for use on six-point nuts (hex nuts) or four-point nuts (square nuts)

The impact tool (150) is adapted for engaging the proximate end of the ground support member (18) cap (19) and transmitting percussive and rotational movement to the ground support member (18) during insertion through the resin (13). The impact tool (150) is designed to transmit the impact force from the hammer plate of a jackleg drill (14) directly to the cap (19) of a ground support member (18). Field tests show that the use of this tool (150) on the end of the jackleg drill (14) and the hammering action of the jackleg drill (14) increases the insertion rate of the ground support member (18) through the resin (13). The hammering forces are transferred to the ground support member (18) through a cap (19).

The cap (19) is hardened to prevent deformation under impact load. The cap (19) protects the ground support member (18) from damage and it provides the engaging mechanism to spin the ground support member (18) as it is being installed in the first hole (20) with resin (13). A standard flange nut (not shown) is used on the proximate threaded end of the ground support member (18) to allow tensioning of the ground support member (18). After the impact tool seats and spins the ground support member (18) it is removed and a tensioning tool can be used to engage and rotate the flange nut for tensioning. This is a standard tool with the "throat" reamed out to allow passage of the tool over the cap nut.

In another example of the device there is provided a system for installing a ground support member (18) comprising a jackleg drill (14) for drilling a first hole (20) for permanently accepting the ground support member (18) and a second hole (112) for temporarily accepting an anchoring means (24). The jackleg drill (14) is also used to provide thrust to the ground support member (18) during insertion into the first hole (20). There is further provided a ground support member (18) member insertion device (10) temporarily mounted to the jackleg drill (14) for holding the ground support member (18) during insertion into the first hole (20). The device acts in cooperation with the anchoring member (110) to stabilize the jackleg drill (14) during insertion. The system further comprises an impact tool (150) temporarily fixable to the jackleg drill (14) for engaging the proximate end of the ground support member (18) and transmitting percussive and rotational forces from the jackleg drill (14) to the cap (19) of the ground support member (18) during installation.

In another example of the embodiments, there is a method for inserting a ground support member permanently into a first hole comprising the steps of:

a. drilling a first hole having a first depth using a rock drill mounted to a jackleg drill;
b. inserting a binding resin into the first hole;
c. drilling a second hole having a second depth using the rock drill wherein the depth of the second hole is less than the depth of the first hole;
d. installing a ground support member insertion device onto the jackleg drill, wherein the ground support member insertion device comprises:
e. attaching means for attaching the device to the jackleg drill;
f. a clutch assembly disposed adjacent to the attaching means for holding a ground support member while permitting movement of the ground support member in a distal direction and preventing movement in a proximate direction; and,
g. anchoring means disposed opposite the clutch assembly wherein the anchoring member comprises an anchoring member adapted for temporarily anchoring the device in the second hole during insertion of the ground support member;
h. temporarily fixing the anchoring member to the ground support member insertion device;
i. maneuvering the jackleg drill so that the anchoring member is inserted into the second hold and the ground support member insertion device is poised below the first hole;
j. inserting a ground support member into the clutch assembly, wherein the ground support member comprises a distal end for insertion into the first hole and a proximate end adapted to receive thrust from the jackleg drill, and wherein the ground support member is held stationary within the clutch until a first thrust is applied from the jackleg drill;
k. applying a first thrust from the jackleg drill to the proximate end of the ground support member thereby forcing it through the clutch and into the first hole a first distance so that the distal end of the ground support member engages the binding resin;
l. withdrawing the jackleg drill a second distance thereby removing thrust from the ground support member and engaging the clutch so that the ground support member is held stationary;
m. applying a second thrust to the proximate end of the ground support member in order to move it a second distance into the first hole;
n. repeating steps k to m until the ground support member is in a desired location; removing the ground support member insertion device from the jackleg drill; and o. installing an impact tool on the drill whereby the distal end of the impact tool engages the proximate end of the ground support member thereby permitting the transmission of percussive and rotational forces from the rock drill to the ground support member until the resin mix is achieved around the ground support member.

Figure 11:
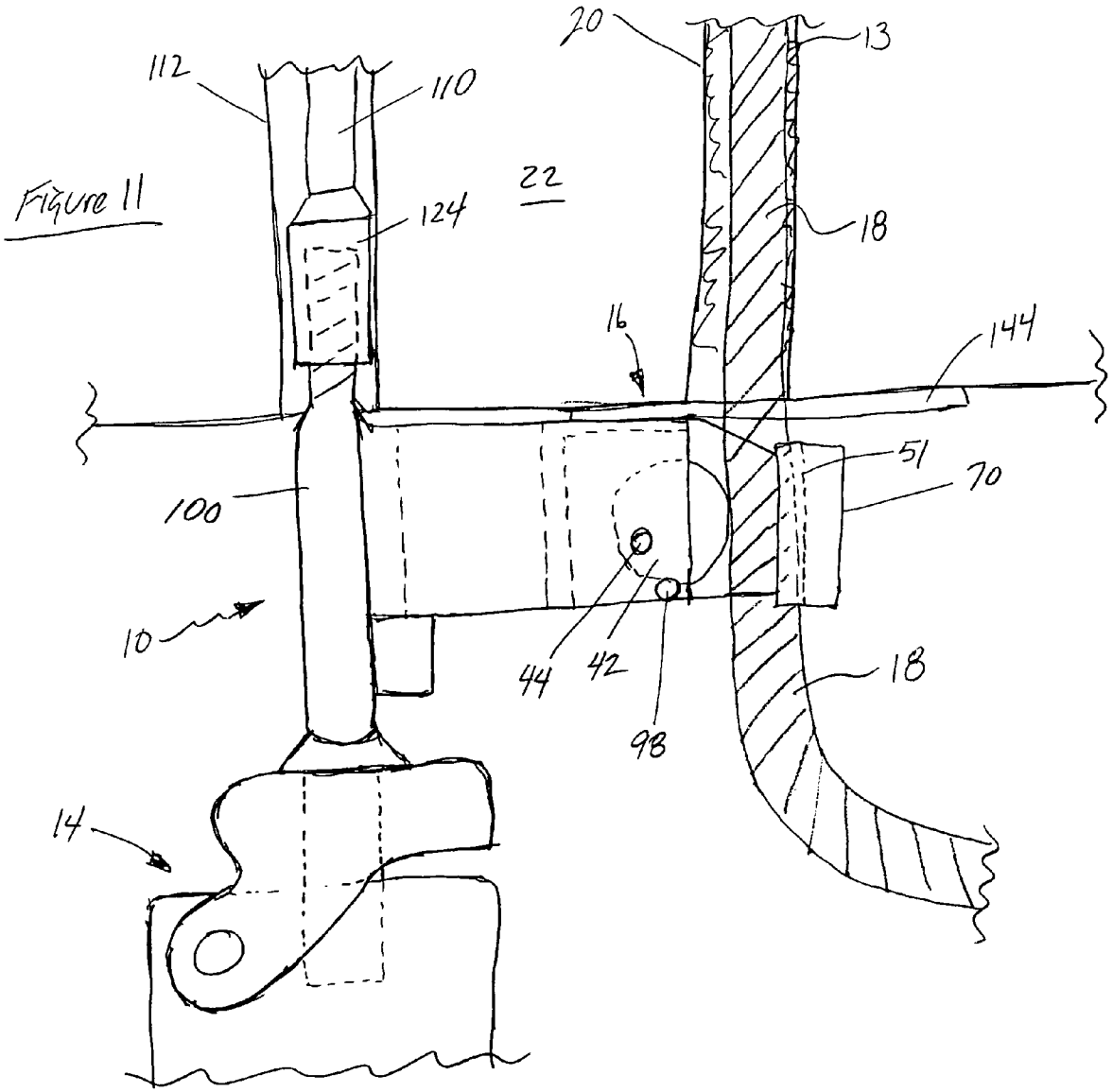
FIG. 11 shows a side view of one embodiment of the insertion device in use.

FIG. 11 shows a side view of one embodiment of the support member insertion device (10) mounted on a jackleg drill (14). In this figure, it can be seen that the first projection member (100) is attached to an anchoring member (110) that has been inserted into the second predrilled hole (112).

The distal end of the ground support member (18) is inserted through a hole in plate (144) and the distal end of support member (18) is then inserted into first drill hole 20 and configured such that plate (144) is secured between the insertion device (10) and the roof of the rock body (22) as shown in FIG. 11. The ground support member (18) can then be inserted into clutch assembly (16) between the roller (42) and groove (51).

Alternatively, the plate (144) can be placed on top of the insertion device (10) and aligned such that when the support member (18) is fed between the roller (42) and groove (51), it aligns with the hole in plate (144) and first drill hole (20).

The first drill hole (20) has had resin (13) inserted prior to the insertion of the support member (18) as has been discussed prior. The support member (18) continues to be inserted into first drill hole (20) for the full length of support member (18). Support member (18) can either be inserted manually or by a mechanical device.

Figure 12:
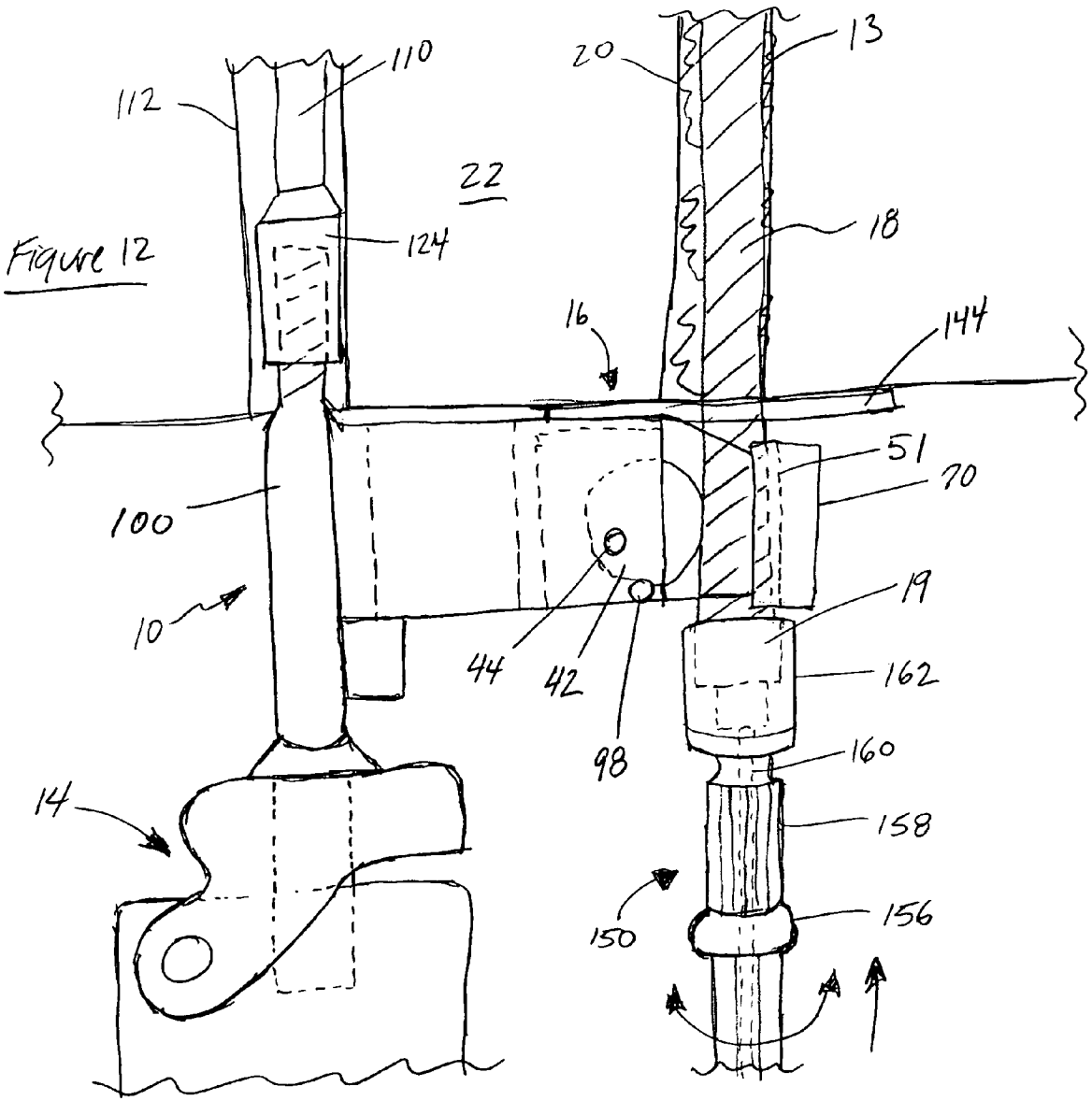
FIG. 12 shows a side view of one embodiment of the insertion device in use.

Once the support member (18) has been inserted to nearly the complete length as in FIG. 12, and impact tool (150) can be used. The impact tool (150) is attached to a cap (19) on the proximate end of the support member (18). The cap (19) can have edges or be configured in a manner to match the socket (162) of the impact tool (150). The impact tool (150) can be attached to a second jackleg drill (14) (not shown). The impact tool (150) can then be used to rotate the support member (18) to break up resin (13) to secure the support member (18) to first drill hole (20) as has been described previously. Impact tool (150) can also be used to impact the cap (19) to drive the cap (19) against the plate (144) to secure the plate (144) to the roof of rock body (22).

FIG. 12 shows the impact tool (150) located below the insertion device (10). In this figure, the clutch assembly (16) roller (42) could be released form the support member (18) and the impact tool (150) with jackleg drill (14) (not shown) could be used to drive the support member (18) cap (19) flush with the plate (144). Alternatively, impact tool (150) can be sized such that it would be capable of insertion between the roller (42) and groove (51) until the cap (19) was flush with plate (144). The clutch assembly (16) of insertion device (10) could then be released from impact tool (150) and insertion device (10) and attached jackleg drill (14) could be removed. The user could continue to twist support member (18) either manually or mechanically such that the resin (13) is thoroughly mixed and support member (18) has been fully inserted.

The impact tool (150) could also be used to adjust a nut (not shown) on the proximate end of the support member (18) to tension support member (18) and secure plate (144) to rock body (22) as is well known in the art.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. An impact tool used with a jackleg drill for inserting a ground support member into a first drill hole, the impact tool comprising:

a shaft having a hollow core and a first end and a second end;

a hollow core socket on the second end;

a flange located between the first end and the second end;

the flange having a diameter large than the diameter of the first end;

the first end for insertion into the jack leg drill to the depth of the flange and the socket on the second end for engaging a cap on the ground support member; and whereby the jackleg drill rotates the tool to spin the ground support member in the first drill hole and impacts the cap to drive the ground support member into the first drill hole.

2. The impact tool of claim 1 further comprising:

the shaft having a hexagonal cross section between the first end and the flange.

3. The impact tool of claim 1 further comprising:

the shaft having a fluted cross section between the flange and the second end.

4. A tool used with a jackleg drill for inserting a ground support member into a first drill hole and rotating the ground support member to puncture and mix resin packages, the tool comprising:

a shaft having a hollow core and a first end and a second end;

a hollow core socket on the second end;

a flange located between the first end and the second end;

the diameter of the flange larger than the diameter of the first end;

the first end for attachment into the jack leg drill to the depth of the flange and the socket on the second end for engaging a cap on the ground support member; and whereby the jackleg drill rotates the tool to spin the ground support member in the first drill hole to puncture and mix the resin packages and impacts the tool to contact the cap and drive the ground support member into the first drill hole.

5. The impact tool of claim 4 further comprising:

the shaft having a hexagonal cross section between the first end and the flange.

6. The impact tool of claim 4 further comprising:

the shaft having a fluted cross section between the flange and the second end.

7. A method of inserting a ground support member into a rock body, the method comprising:

drilling a first drill hole and second predrilled hole into the rock body where the first drill hole is has a length slightly deeper than a ground support member and the second predrilled hole is shorter than the first drill hole;

inserting resin mix into the first drill hole;

attaching a support member insertion device to a jackleg drill;

attaching an anchoring member to the support member insertion device;

elevating the support member insertion device and jackleg drill such that the anchoring member is partially inserted into the second predrilled hole;

placing a plate on top of the support member insertion device such that a hole in the plate is over the opening between a roller and a groove in the support member insertion device;

elevating the jackleg drill and support member insertion device and plate such that the plate is flush against the rock body;

inserting the distal end of the ground support member between the roller and the groove of the support member insertion device and feeding the distal end through the hole in the plate and into the first drill hole;

attaching a second jackleg drill to the ground support member and elevating the second jackleg drill such that the distal end is further inserted into the first drill hole;

releasing the ground support member from the second jackleg drill and lowering the second jack leg drill;

again attaching the second jackleg drill to the ground support member;

elevating the second jackleg drill to drive the ground support member further into the first drill hole;

repeatedly attaching, elevating and releasing the second jackleg drill until the proximate end of the ground support member is near the plate;

removing the second jackleg drill from the ground support member and lowering the second jackleg drill;

attaching an impact tool to the second jackleg drill and raising to affix the impact tool to the proximate end of the ground support member;

removing the first jackleg drill and support member insertion device from the ground support member and lowering the first jackleg drill;

elevating, rotating and impacting the proximate end of the ground support member with the second jackleg drill until the resin is mixed and the proximate end is flush with the plate; and rotating the impact tool to turn a nut on the proximate end to tension the ground support member either by hand or with the second jackleg drill.

* * * * *